United States Patent [19]

Combs

[11] 4,292,892

[45] Oct. 6, 1981

[54] CONVEYOR APPARATUS FOR PRESS MACHINES

[76] Inventor: William Combs, 6131 Canmoor, Troy, Mich. 48084

[21] Appl. No.: 173,466

[22] Filed: Jul. 30, 1980

[51] Int. Cl.[3] ..... B30B 15/32

[52] U.S. Cl. ..... 100/218; 79/421; 83/81; 198/859; 414/15

[58] Field of Search ..... 100/215, 218, 207, 216, 100/45, 222; 83/81, 82; 72/426, 427, 428, 421; 414/15; 198/341, 859

[56] References Cited

U.S. PATENT DOCUMENTS 1,625,026 4/1927 Holmes ..... 100/222
3,529,542 9/1970 Rasenberger ..... 100/215

FOREIGN PATENT DOCUMENTS 872308 7/1961 United Kingdom ..... 100/218

*Primary Examiner*—Billy J. Wilhite
*Attorney, Agent, or Firm*—Basile, Weintraub & Hanlon

[57] ABSTRACT

A conveyor for conveying material from a press machine. The conveyor is advanced by apparatus adapted to be connected toi the movable head of the press machine. The apparatus includes an arm having a plurality of outwardly extending fingers which is connected to the head of the press machine for movement therewith. A rachet wheel having a plurality of circumferentially spaced finger engaging members is fixably mounted to the drive rod of the conveyor. The fingers on the arm engage the finger engaging members of the rachet wheel upon movement of the head of the press in a first direction which causes the rachet wheel as well as the drive rod to rotate. The rotation of the drive rod results in an incremental advance of the conveyor which removes material deposited thereon from the press machine.

8 Claims, 6 Drawing Figures

CONVEYOR APPARATUS FOR PRESS MACHINES

BACKGROUND OF THE INVENTION

1. Field of the Invention

This invention, in general, to conveyor apparatus and, more specifically, to conveyor apparatus for conveying material from press machines.

2. Description of the Prior Art

In the material forming industry, press machines are commonly utilized to perform a wide variety of cutting, piercing and other forming operations on material in order to form the material to the desired shape. Such press machines typically comprise a press having a base and a movable head. Male and female dies are mounted to the base and the movable head, respectively, such that movement of the head, typically in a downward direction, will bring the dies into mating engagement and form the material disposed therebetween to the desired shape.

In such an operation, considerable quantities of scrap material are generated. This scrap material must be removed if efficient, high speed press operation is to be maintained. In some press operations, the scrap material is allowed or is directed to fall from the die area in the press onto the floor surrounding the press machine. Due to the high speed operations of todays press machines, considerable quantities of scrap are quickly generated. This amount of scrap poses a danger to the operator of the press as well as requiring intermittent stoppage of the press operation in order to remove the scrap from the immediate press area.

It is known to provide a continually moving conveyor to remove scrap from the immediate area of the press. The most common type of continuously operating conveyor includes an electric drive motor which operates a conveyor disposed so as to receive the scrap directly from the press after the completion of each forming cycle and to continuously remove it from the die area. Although effective, this continuous operation of the conveyor consumes energy even during the portion of the press cycle where no scrap is being generated. In addition, the continuous operation causes considerable wear on the moving parts of the conveyor causing frequent breakdowns and stoppages in order to repair or replace the worn or broken components. This results in a further loss of production.

Thus, it would be desirable to provide a means for conveying material, particularly scrap material, from a press machine which overcomes the problems of prior art material removal apparatus. It would also be desirable to provide a means for conveying material from a press machine which reduces the wear on the material removing components. It would also be desirable to provide a means for conveying material from a press machine which reduces the energy required by the use of such material removal equipment compared to similar prior art material removal equipment. Finally, it would be desirable to provide a means for conveying material from a press machine which is adapted to fit a wide variety of press machine applications.

SUMMARY OF THE INVENTION

There is disclosed herein a new and improved conveyor suitable for use with a press machine. The conveyor of this invention includes means for conveying material from the press area and means for advancing the conveyor. The advancing means comprises an arm adapted to be coupled to the movable head of the press machine. The arm includes a plurality of linearly spaced, outwardly extending fingers. A rachet wheel is fixedly mounted to the drive rod of the conveying means and includes a plurality of circumferentially spaced finger engaging members.

During movement of the press head, successive ones of the fingers on the arm respectively engage the finger engaging members on the rachet wheel causing rotation of the rachet wheel in a first direction. The rotation of the rachet wheel causes a corresponding rotation in the drive rod of the conveyor which is translated into a linear movement of the conveyor causing removal of material disposed on the conveyor from the press area. During the completion of the press cycle, in which the press head moves in a second or opposite direction, the fingers on the arm disengage from the finger engaging member such that further rotation of the rachet wheel and the drive rod is halted.

The novel conveyor apparatus of this invention provides significant advantages over prior art conveyor apparatus suitable for use with press machines. For one, the conveyor means is advanced by apparatus coupled to the movable head of the press machine. In this manner, the conveyor is advanced without any further use of energy as commonly required by separately driven, continuously running conveyors used in the prior art. In this invention, the press drive itself is utilized to advance the conveyor. Furthermore, the conveyor is advanced only upon movement of the press head in one direction, i.e. in a downward direction. This results in intermittent advance of the conveyor which significantly reduces the amount of wear on the movable parts of the conveying apparatus thereby eliminating the need for the constant repair and replacement of parts.

Finally, the conveyor apparatus of this invention is adaptable for use in a wide variety of press machine applications. Means are provided for adjustably connecting the arm to the movable head of the press. This adjustment means enables the conveyor apparatus of this invention to be attached to a wide variety of different sized press machines as well as to enable several different modes of operation of the conveyor apparatus, i.e. directions of discharge of the material. Furthermore, the conveyor apparatus is suited for a wide variety of different sized conveyor belts thereby enabling the conveyor apparatus of this invention to be used with a large number of different sized dies and presses.

BRIEF DESCRIPTION OF THE DRAWING

The various features, advantages and other uses of this invention will become more apparent by referring to the following detailed description and drawing in which.

DESCRIPTION OF THE PREFERRED EMBODIMENTS

Figure 1:
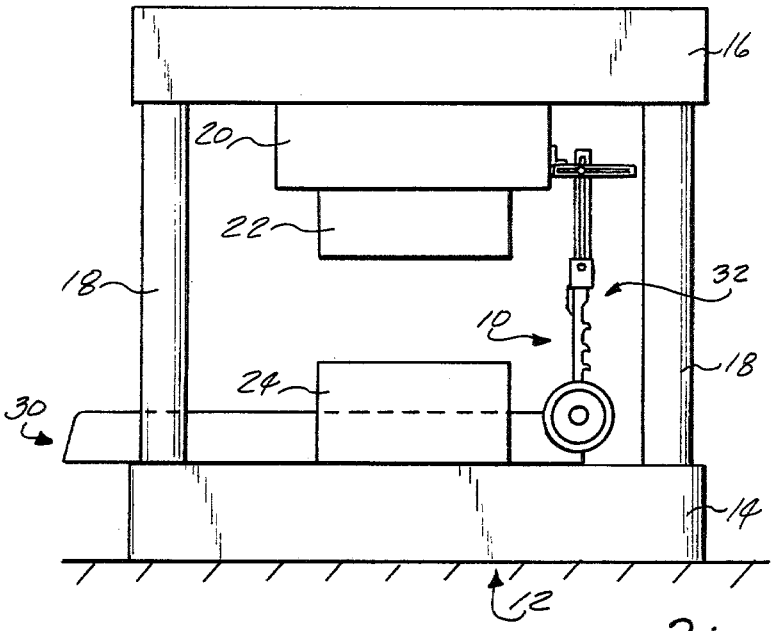
FIG. 1 is a plan view of a conventional press machine incorporating the conveyor apparatus of this invention.

Referring now to the drawing, and to FIG. 1 in particular, there is shown a conveyor apparatus 10 constructed according to the teachings of this invention which is suitable for use in a conventional press machine 12. In order to provide a clear understanding of the uses of the conveyor apparatus of this invention, a general description of the construction and operation of the press machine 12 will be initially presented. However, it will be understood that the following discussion and description of the press machine 12 is by way of illustration and not of limitation as the conveyor apparatus 10 of this invention is adaptable for use with any type of press machine.

Accordingly, the press machine 12 comprises a suitable frame assembly consisting of a base 14, a top portion 16 and corner support posts 18. The top portion 16 typically houses the necessary controls and drive equipment to operate the press. In addition, the top portion 16 houses a movable head or ram 20. During each cycle of operation, the ram 20 moves in first direction, typically downward, although a bottom mounted ram may also be utilized. Male and female dies 22 and 24 are secured to the ram 20 and base 14, respectively, of the press machine 12. The male and female dies 22 and 24 are formed to provide any desired material forming operation, such as cutting, piercing, etc. Thus, during the initial movement of the ram 20 in a downward direction, the male and female dies 22 and 24 are brought into mating engagement such that a material sheet, not shown, disposed therebetween will be formed to the desired shape. As is well known in the art, such material forming operations generate considerable quantities of scrap. It is the purpose of the conveyor apparatus 10 of this invention to remove such scrap from the press machine 12 in an economical and efficient manner.

Figures 2, 5:
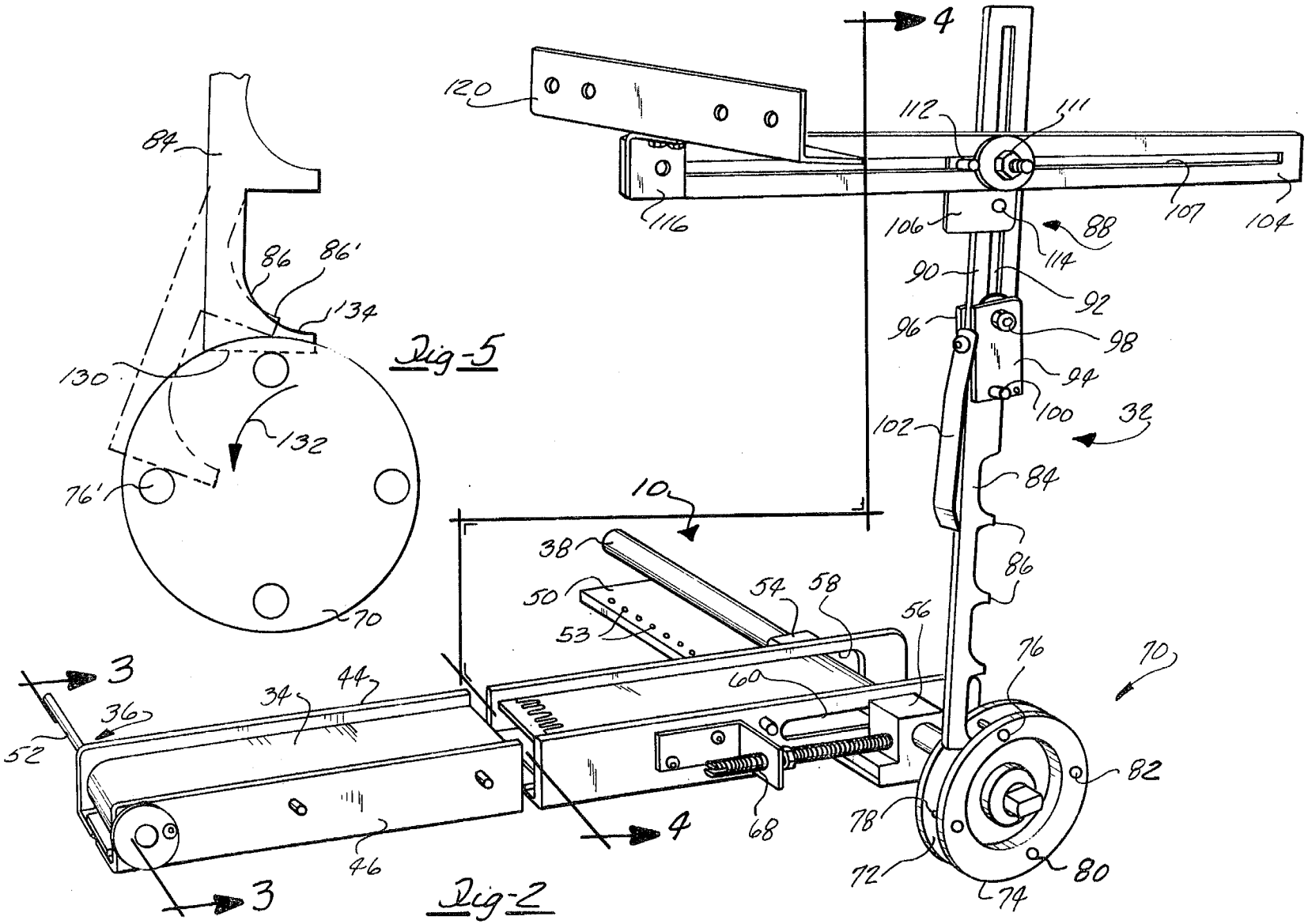
FIG. 2 is a perspective view of the conveyor apparatus constructed according to the teachings of this invention.
FIG. 5 is a pictorial representation of the position the arm and rachet wheel of the conveyor apparatus of this invention occupy during a portion of the cycle of the conveyor apparatus.

Referring now to FIGS. 1 and 2, the general construction of the conveyor apparatus 10 of this invention will now be described. As shown therein, the conveyor apparatus 10 generally includes means 30 for conveying material from the press machine 12. The conveying means 30 is located within the press machine 12 between the parallels or legs of the female die 24. Conventional female dies are formed with apertures therein such that the scrap generated during the forming operation will drop therethrough onto the conveying means 30 located therebeneath. Conveying means 30 then functions to remove such scrap material from the machine 12.

The conveying apparatus 10 of this invention further includes means 32 for advancing the conveying means 30. According to a novel aspect of this invention, the advancing means 32 is adapted to be connected to movable head 20 of the press machine 12 so as to be driven thereby. The advancing means 32 is coupled to the conveying means 30 such that movement of the advancing means 32 in conjunction with movement of the movable head 20 of the press machine 12 results in an intermittent advance of the conveying means 30 to remove the scrap material from the immediate area of the press machine 12.

Figure 3:
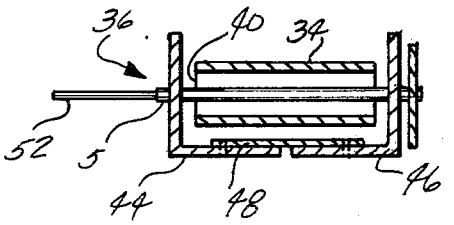
FIG. 3 is a cross sectional view, generally taken along line 3—3 in FIG. 2.
Figure 4:
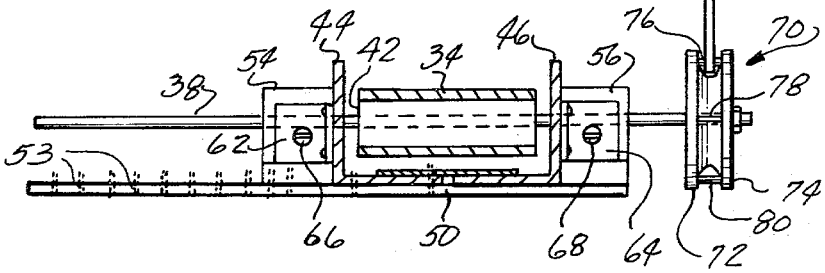
FIG. 4 is a cross sectional view, generally taken along line 4—4 in FIG. 2.

According to the teachings of the preferred embodiment of this invention, the conveyor means 30 includes a belt 34, as shown in FIGS. 2, 3 and 4. The belt 34 may be formed of any suitable heavy gauge material for withstanding the forces generated thereon by the heavy and typically sharped edged material dropped thereon during the material forming operation. Thus, the belt may be formed of any suitable material such as wire mesh. The belt 34 is in the form of a continuous loop of material and is disposed around spaced rods or pistons 36 and 38. Conventional cylindrical bushings 40 and 42 are disposed over the respective rods 36 and 38 between the rods 36 and 38 and the belt 34. The rods 36 and 38 and the corresponding bushings 40 and 42 are rotatably mounted between a pair of angle brackets 44 and 46. The angle brackets 44 and 46 extend the entire length of the belt 34. As shown more clearly in FIG. 3, the angle brackets 44 and 46 are held in the desired spaced relationship at the first or discharge end of conveyor 30 by means of a plate 48. The plate 48 is secured to the angle brackets 44 and 46 in any conventional manner, such as by bolting the components together. As shown in FIG. 3, the rod 36 is formed of two telescopingly engageable cylindrical members 51 and 52. In this manner, the rod 36 may be extended so as to enable different sized belts 34 to be mounted within the conveying means 30. In such an instance, a bushing 40 having a length corresponding to that of the belt size 34 will also be installed over the rod 36.

As shown in FIG. 2, and more clearly in FIG. 4, the angle brackets 44 and 46 are held in a desired spaced relationship at the second or input end of the conveying apparatus 30 by means of a plate 50. As with the plate 48 at the first end of the conveying means 30, the plate 50 secured to the angle brackets 44 and 46 in any conventional manner, such as by bolting. In addition, the plate 50 includes a plurality of linearally spaced apertures, shown generally by reference number 53 which enable the angle bracket 44 to be selectively spaced from the corresponding angle bracket 46 to enable different sized belts 34 to be mounted therebetween depending upon the particular application of the conveyor apparatus 10 of this invention. As shown in FIG. 4, the rod 38 has an extended length such that the different sized belts 34 may be easily disposed thereover.

In addition, the rod 38 is rotatably mounted within a pair of spaced bushing blocks 54 and 56. The bushing blocks 54 and 56 are disposed adjacent to the angle brackets 44 and 46 and include a suitable bushing therein for rotatably mounting the drive rod 38. Further, the bushing blocks 54 and 56 are mounted to the plate 50 in any conventional manner, such as by welding.

As shown in FIG. 2, the ends of the angle brackets 44 and 46 at the second or input end of the conveying apparatus 30 include a pair of corresponding slots 58 and 60. The drive rod 38 extends through the slots 58 and 60. The slots 58 and 60 enable the belt 34 to be tightened which is necessary to eliminate any slack in the belt that occurs during extended use thereof.

Accordingly, means for tightening the belt 34 are provided. The tightening means includes a pair of spaced angle brackets 62 and 64, shown in FIG. 4. The angle brackets 62 and 64 are respectively secured, such as by bolting, to the angle brackets 44 and 46. The angle brackets 62 and 64 further include an outwardly extending leg portion through which is mounted an adjustable screw 66 and 68, respectively. The screws 66 and 68 abut the bushing blocks 54 and 56 respectively, at a first end and are adjustably secured to the leg portion of the angle brackets 62 and 64 at an intermediate portion thereof. In this manner, the screws 66 and 68 may be adjusted so as to move the bushing blocks 54 and 56 and correspondingly the drive rod 38 and the second end of the belt 34 along the slots 58 and 60 to provide increased tension on the belt 34 and thereby eliminate any slack therein.

As shown in FIGS. 2 and 4, the advancing means 32 of this invention comprises a rachet wheel, shown generally by reference number 70. The rachet wheel 70 comprises a pair of spaced disc-shaped members 72 and 74 which are held in spaced relationship by a plurality of finger engaging members 76, 78, 80 and 82. The finger engaging members 76, 78, 80 and 82 extend between the discs 72 and 74. In addition, the entire rachet wheel assembly 70 is secured or keyed to the drive rod 38 of the conveying means 30. In this manner, the rachet wheel 70 is fixedly mounted to the drive rod 38 for concurrent rotation therewith.

As shown in FIG. 2, four finger engaging members 76, 78, 80 and 82 are utilized in the preferred embodiment of this invention and are circumferentially spaced 90° apart. Although four finger engaging members are illustrated and described, it will be apparent that any number of finger engaging members as well as different spacings therebetween may also be utilized to practice this invention and to utilize the conveyor apparatus 10 in a wide variety of different press machine application involving different press strokes and distances the conveyor 30 must travel for each cycle of the press machine.

The advancing means 32 further includes an arm 84. The arm 84 is adapted to be coupled to the movable head 20 of the press machine 12 by means that will be described in greater detail hereafter. The arm 32 is in the form of a substantially linear member having a plurality of outward extending linearly spaced fingers, shown generally by reference number 86. As with the finger engaging members on the rachet wheel 70, four fingers 86 are illustrated and utilized in the preferred embodiment of this invention. The four fingers 86 are spaced substantially four inches apart so as to engage successive ones of the finger engaging members 76, 78, 80 and 82, in the manner that will be described in greater detail hereafter. It will also be understood that different numbers of fingers 86 may be utilized as well as different spacings therebetween to provide different advancement lengths of the conveyor 30 in accordance with the different press strokes.

According to the preferred embodiment of this invention, the arm 84 is coupled to the movable head of the press 12 by adjustable securing means, shown generally by reference number 88. As shown in FIGS. 2 and 4, the adjustable securing means 88 comprises a first member 90 disposed in a substantial vertical orientation. The member 90 has an integral linearly extending slot 92 formed therein. A pair of opposed plates 94 and 96 are fixedly secured to one end of the first member 90 by a conventional means, such as by nut 98. A dowel or pin 100 extends through both of the plates 94 and 96 and one end of the arm 84. The arm 84 is thus disposed for pivotal movement about the pin 100. A suitable biasing means 102 is provided to urge the arm 84 in a first direction in which the fingers 86 are urged into engagement with the finger engaging members of the rachet wheel 70. As shown in FIG. 2, the biasing means 102 comprises a leaf spring which is affixed to the plates 94 and 96 on one end and is in contact with the arm 84 at the opposite end to urge the arm 84 in a first direction.

The means 88 for adjustably securing the arm 84 to the movable head 20 of the press machine 12 further includes a second member 104 which is disposed in a substantially horizontal orientation. The member 104 also has a linear integral slot 107 extending substantially the entire length thereof.

As shown in FIG. 2 and 4, the first and second members 90 and 104 of the adjustable securing means 88 are disposed in substantially perpendicular intersecting relationship. A plate 106 is disposed between the intersecting portions of the first and second members 90 and 104, respectively. The plate 106 has first and second opposed surfaces 108 and 110, as shown in FIG. 4. First and second pins 112 and 114, respectively, extend outward from the respective first and second surfaces 108 and 110 of the plate 106. The pins 112 and 114 respectively extend through the slots 107 and 92 in the second and first members 104 and 90, respectively. The pins 112 and 114 function to maintain the first and second members 90 and 104 in substantially perpendicular relationship. A suitable fastener, such as nut and bolt 111, extends through the slots 107 and 92 to secure the first and second members 90 and 104 in the desired position.

Figure 6:
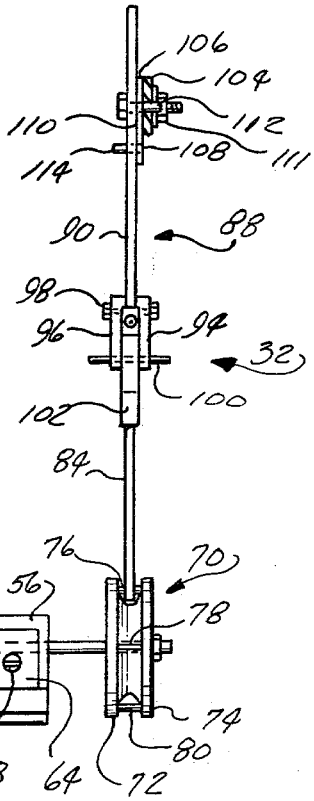
FIGS. 6 is a top view of a portion of the adjustment means utilized to connect the arm to the head of the press machine.
Figure 6:
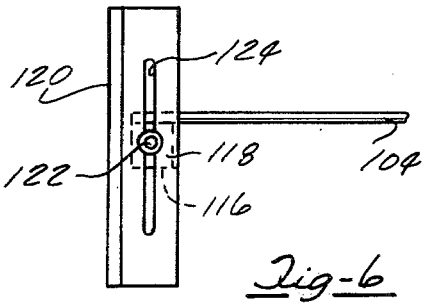

As shown in FIGS. 4 and 6, the adjustable securing means 88 also includes a third member 116. The third member 116, which is in the form of an angle bracket, is secured to the end of the second horizontally extending member 104 of the adjustable securing means 88. The horizontal leg 118 of the third memeber 116 provides a base and securing means for angle bracket 120 which is adapted to be connected to the movable head 20 of the press machine 12. The third member 116 and the angle bracket 120 are connected together in adjustable relationship by suitable means, such as nut and bolt 122 which extends through an integral slot 124 in the angle bracket 120, so as to enable the angle bracket 120 to be slidingly moved inboard and outboard along the head 20 of the press machine 12 such that the entire conveyor apparatus 10 of this invention may be suitably positioned as desired within the press.

Referring now to FIG. 5, the operation of the advancing means 32 in advancing the conveying means 30 will now be described. During initial setup, the first or lower most finger 86 of the arm 84 will be disposed in engaging relationship with the uppermost engaging member 76 of the rachet wheel 70. During such engagement, the inner surface 130 of the first finger 86 will surround and engage the outer periphery of the finger engaging member 76, as shown in FIG. 5. During the start of the press machine cycle, the head 20 will descend in a first direction, i.e. downward. The arm 84 will thus move in a linearally downward direction. The arm 84 and the first or lower most finger 86 will thus impart a force on the finger engaging member 76 engaged therewith which will cause the rachet wheel 70 to move in a counterclockwise direction, as indicated by arrow 132. During this rotation the belt 34 moves to the left, as viewed in FIG. 2, which moves the scrap material out from the press machine 12.

Since, as shown in the apparatus illustrated in FIG. 2, the diameter of the rachet wheel 70 is substantially larger than the diameter of the drive rod 38, a correspondingly smaller rotational advance will be imparted to the drive rod 38 which will cause a small incremental movement of the conveying means 30. Thus, if the diameter of the rachet wheel 70 is approximately four inches, one inch rotational movement of the drive rod 38 will result which will cause an identical one inch movement in the conveyor belt 34. It will also be understood that different rotational movements and advances of the conveyor means 30 may also be achieved by varying the sizes of the drive rod 38 and rachet wheel 70 as well as the spacing and number of the fingers 86 and the finger engaging members.

As the head 20 of the press machine 12 continues its downward stroke, the arm 84 will continually rotate the rachet wheel 70 until it assumes the position shown in phantom in FIG. 5 at which time the finger engaging member 76 which was initially at the top has assumed a position indicated by reference number 76'. At this point, the second finger, indicated by reference number 86', on the arm 84 will be an engagement with the finger engaging member which has assumed the uppermost position on the rachet wheel 70 so as to provide continuous rotation of the rachet wheel 70 as the head 20 of the press machine 12 continues its downward stroke. The remaining fingers 86 of the arm 84 will engage successive ones of the finger engaging members on the rachet wheel 70 causing continued rotation thereof and advance of the conveying means 30 throughout the movement of the head 20 of the press machine 12 in the first or downward direction.

Upon the completion of the downward stroke, the head 20 of the press machine 12 will begin an upward movement. This will drive the arm 84 in a substantially vertical direction which will pull or disengage the fingers 86 from the finger engaging members on the rachet wheel 70. As the outermost surface 134 of each finger 86 has a substantially smooth form, the fingers 86 will easily slide past the finger engaging members on the rachet wheel 70 which will force the arm 84 slightly outward against the biasing force of the spring 102 such that the fingers 86 easily slide past the finger engaging members to totally disengage the arm 84 from the rachet wheel 70.

It will be noted that the orientation of the arm 84 may be rotated 180° from that shown in FIG. 2 and the direction of travel and orientation of the conveying means 30 similarly reversed to provide discharge or removal of the material from the press machine 12 in the opposite direction from that shown in FIG. 2 and described above. This adds additional versatility to the use of the conveyor apparatus 10 of this invention.

Thus, there has been disclosed herein a new and improved conveyor apparatus suitable for use in a press machine to remove scrap material from the press machine. The conveyor apparatus, comprises means for conveying the scrap material from the press machine and means for advancing the conveying apparatus in conjunction with movement of the head of the press machine. An arm having a plurality of outwardly extending fingers is connected to the head of the press machine so as to move therewith. A rachet wheel having a plurality of circumferentially spaced finger engaging members is fixedly mounted about the drive rod of the conveying means. During movement of the press head in a first direction, the fingers on the arm successively engage the finger engaging member on the rachet wheel causing rotation of the rachet wheel and the drive rod of the conveying means which results in an incremental advance of the conveying means. Such a construction significantly reduces the amount of wear on the components of the conveying means compared to conventional continuously operating prior art conveying apparatus as well as eliminating any energy usage required by the use of such material removing systems.

What is claimed is:

1. A conveyor apparatus for use with a press machine having a movable head comprising:

means for conveying material from said press machine, said conveying means including a drive rod coupled to said conveying means for moving said conveying means; and means for advancing said conveying means, said advancing means comprising:

a rachet wheel fixedly mounted on said drive rod, said rachet wheel including a plurality of circumferentially spaced finger engaging members; and an arm adapted to be connected to said press head for movement therewith, said arm having a plurality of linearly spaced fingers extending outward therefrom, wherein successive ones of said fingers engage said finger engaging members on said rachet wheel causing rotation of said rachet wheel and said drive rod to advance said conveying means upon movement of said press head.

2. The conveyor apparatus of claim 1 wherein the finger engages the fingers engaging members upon movement of the press head in one direction only.

3. The conveyor apparatus of claim 1 further including means for adjustably securing the arm to the press head.

4. The conveyor apparatus of claim 3 wherein the adjustable securing means is adjustable in both the horizontal and vertical directions.

5. The conveyor apparatus of claim 3 wherein the arm is pivotally connected to the adjustably securing means and wherein said conveyor apparatus further includes means for biasing said arm such that the fingers are urged into engagement with the finger engaging members upon movement of the head of the press in a first direction only.

6. The conveyor apparatus of claim 3 wherein the adjustably securing means comprises:

a substantially vertically extending first member having the arm connected at a first end thereof, said first member having an integral linearly extending slot formed therein;

a substantially horizontally extending second member having an integral slot extending linearly therein;

said first and second members being disposed in substantially perpendicular intersecting relationship;

a plate member disposed between said first and second members, said plate member having first and second pins and first and second opposed surfaces;

said first pin extending from said first surface of said plate member and adapted to be slidingly disposed within said slot in said first member;

said second pin extending from said second surface of said plate member and adapted to be slidingly disposed within said slot in said second member; and means for fixedly securing said plate member and said first and second members together in fixed relationship.

7. The conveyor apparatus of claim 1 wherein the rachet wheel includes four finger engaging members, each disposed 90° apart around said rachet wheel.

8. The conveyor apparatus of claim 1 wherein the conveying means includes a continuous belt adapted to receive material from the press machine, said belt being disposed around the drive rod of said conveying means to be linearly moved upon rotation of said drive rod.

* * * * *

UNITED STATES PATENT AND TRADEMARK OFFICE

CERTIFICATE OF CORRECTION

PATENT NO. : 4,292,892

DATED : October 6, 1981

INVENTOR(S) : William Combs

It is certified that error appears in the above-identified patent and that said Letters Patent are hereby corrected as shown below:

In the drawing, sheet 1, Figure 3, the reference numeral 5 should be reference numeral 51.

In the abstract, line 3, following "connected" delete "toi" and insert --to--.

Column 8, line 24, delete "finger engages the fingers" and insert --fingers engage the finger--.

Signed and Sealed this

*Nineteenth* Day of *January 1982*

[SEAL]

*Attest:*

GERALD J. MOSSINGHOFF

*Attesting Officer* *Commissioner of Patents and Trademarks*